US008157983B2

(12) United States Patent
Bennett

(10) Patent No.: US 8,157,983 B2
(45) Date of Patent: Apr. 17, 2012

(54) COMPOSITE ANODE FOR CATHODIC PROTECTION

(76) Inventor: John E. Bennett, Chardon, OH (US)

( * ) Notice: Subject to any disclaimer, the term of this patent is extended or adjusted under 35 U.S.C. 154(b) by 289 days.

(21) Appl. No.: 12/531,779

(22) PCT Filed: Feb. 25, 2008

(86) PCT No.: PCT/US2008/054839

§ 371 (c)(1),
(2), (4) Date: Sep. 17, 2009

(87) PCT Pub. No.: WO2008/118589

PCT Pub. Date: Oct. 2, 2008

(65) Prior Publication Data

US 2010/0038261 A1 Feb. 18, 2010

Related U.S. Application Data

(63) Continuation of application No. PCT/US2007/07317, filed on Mar. 24, 2007.

(51) Int. Cl.
*C23F 13/14* (2006.01)

(52) U.S. Cl. ..... 205/734; 205/730; 204/196.22; 204/196.25; 204/196.36

(58) Field of Classification Search ..... 205/734, 205/730; 204/196.36, 196.25, 196.22
See application file for complete search history.

(56) References Cited

U.S. PATENT DOCUMENTS

| | | | | | |
|---|---|---|---|---|---|
| 5,292,411 | A * | 3/1994 | Bartholomew et al. | ..... | 205/731 |
| 5,370,783 | A * | 12/1994 | Carlson et al. | ..... | 204/435 |
| 6,022,469 | A | 2/2000 | Page | | |
| 6,033,553 | A | 3/2000 | Bennett | | |
| 6,165,346 | A * | 12/2000 | Whitmore | ..... | 205/734 |
| 6,193,857 | B1 | 2/2001 | Davison et al. | | |
| 6,217,742 | B1 | 4/2001 | Bennett | | |
| 6,471,851 | B1 | 10/2002 | Bennett | | |
| 6,572,760 | B2 | 6/2003 | Whitmore | | |
| 6,838,525 | B2 | 1/2005 | Pitchumani et al. | | |
| 7,008,971 | B2 | 3/2006 | Taft, III | | |
| 7,160,433 | B2 | 1/2007 | Bennett | | |
| 7,276,144 | B2 * | 10/2007 | Whitmore | ..... | 205/734 |
| 2003/0155551 | A1 * | 8/2003 | Payne et al. | ..... | 252/194 |

OTHER PUBLICATIONS

PCT International Search Report issued May 21, 2008 re PCT/US07/07317, filed Mar. 24, 2007, entitled Activating Matrix for Cathodic Protection.

PCT International Preliminary Report on Patentability issued Oct. 8, 2008 re PCT/US07/07317, filed Mar. 24, 2007, entitled Activating Matrix for Cathodic Protection.

PCT International Search Report issued Jun. 5, 2008 re PCT/US08/54839, filed Feb. 25, 2008, entitled Composite Anode for Cathodic Protection.

* cited by examiner

*Primary Examiner* — Bruce Bell

(74) *Attorney, Agent, or Firm* — James A. Lucas; Driggs, Hogg, Daugherty & Del Zoppo Co., LPA

(57) ABSTRACT

The galvanic cathodic protection of steel embedded in concrete structures is enhanced by the utilization of a flexible composite anode assembly containing a sacrificial anode member. The anode member is at least partially covered by a matrix comprising an ionically-conductive material. The conductive material includes at least one electrochemical activating agent such as a mixture of lithium bromide and lithium nitrate and a compressible water-retaining mineral such as a phyllosilicate mineral. The presence of this mineral in the matrix increases the current delivered by the anode, thereby resulting in a greater level of cathodic protection, and a longer effective service life of the anode. Exfoliated vermiculite is a preferred phyllosilicate mineral and is present in an amount of between about 2% and about 15% by weight, based on the total weight of the matrix.

19 Claims, 2 Drawing Sheets

COMPOSITE ANODE FOR CATHODIC PROTECTION

RELATED APPLICATIONS

This application is a national filing of PCT application Ser. No. PCT/US08/54839, filed Feb. 25, 2008, which claims priority of PCT application Ser. No. PCT/US07/07317, filed Mar. 24, 2007.

BACKGROUND OF THE INVENTION

1. Technical Field

This invention generally relates to the field of galvanic cathodic protection of steel embedded in concrete structures, and is particularly concerned with the performance of embedded sacrificial anodes, such as zinc, aluminum, and alloys thereof.

2. Background Art

The problems associated with corrosion-induced deterioration of reinforced concrete structures are now well understood. Steel reinforcement has generally performed well over the years in concrete structures such as bridges, buildings, parking structures, piers, and wharves, since the alkaline environment of concrete causes the surface of the steel to "passivate" such that it does not corrode. Unfortunately, since concrete is inherently somewhat porous, exposure to salt over a number of years results in the concrete becoming contaminated with chloride ions. Salt is commonly introduced in the form of seawater, set accelerators, or deicing salt.

When the chloride reaches the level of the reinforcing steel, and exceeds a certain threshold level for contamination, it destroys the ability of the concrete to keep the steel in a passive, non-corrosive state. It has been determined that a chloride concentration of 0.6 Kg per cubic meter of concrete is a critical value above which corrosion of the steel can occur. The products of corrosion of the steel occupy 2.5 to 4 times the volume of the original steel, and this expansion exerts a tremendous tensile force on the surrounding concrete. When this tensile force exceeds the tensile strength of the concrete, cracking and delaminations develop. With continued corrosion, freezing and thawing, and traffic pounding, the utility or integrity of the structure is finally compromised and repair or replacement becomes necessary. Reinforced concrete structures continue to deteriorate at an alarming rate. In a recent report to Congress, the Federal Highway Administration reported that of the nation's 577,000 bridges, 266,000 (39% of the total) were classified as deficient, and that 134,000 (23% of the total) were classified as structurally deficient. Structurally deficient bridges are those that are closed, restricted to light vehicles only, or that require immediate rehabilitation to remain open. The damage on most of these bridges is caused by corrosion. The United States Department of Transportation has estimated that $90.9 billion will be needed to replace or repair the damage on these existing bridges.

Many solutions to this problem have been proposed, including higher quality concrete, improved construction practices, increased concrete cover over the reinforcing steel, specialty concretes, corrosion inhibiting admixtures, surface sealers, and electrochemical techniques, such as cathodic protection and chloride removal. Of these techniques, only cathodic protection is capable of controlling corrosion of reinforcing steel over an extended period of time without complete removal of the salt-contaminated concrete.

Cathodic protection reduces or eliminates corrosion of the steel by making it the cathode of an electrochemical cell. This results in cathodic polarization of the steel, which tends to suppress oxidation reactions (such as corrosion) in favor of reduction reactions (such as oxygen reduction). Cathodic protection was first applied to a reinforced concrete bridge deck in 1973. Since then, understanding and techniques have improved, and today cathodic protection has been applied to over one million square meters of concrete structure worldwide. Anodes, in particular, have been the subject of much attention, and several different types of anodes have evolved for specific circumstances and different types of structures.

The most commonly used type of cathodic protection system is impressed current cathodic protection (ICCP), which is characterized by the use of inert anodes, such as carbon, titanium suboxide, and most commonly, catalyzed titanium. ICCP also requires the use of an auxiliary power supply to cause protective current to flow through the circuit, along with attendant wiring and electrical conduit. This type of cathodic protection has been generally successful, but problems have been reported with reliability and maintenance of the power supply. Problems have also been reported related to the durability of the anode itself, as well as the concrete immediately adjacent to the anode, since one of the products of reaction at an inert anode is acid ($H^+$). Acid attacks the integrity of the cement paste phase within concrete. Finally, the complexity of ICCP systems requires additional monitoring and maintenance, which results in additional operating costs.

A second type of cathodic protection, known as galvanic cathodic protection (GCP), offers certain important advantages over ICCP. GCP uses sacrificial anodes, such as zinc and aluminum, and alloys thereof, which have inherently negative electrochemical potentials. When such anodes are used, protective current flows in the circuit without need for an external power supply since the reactions that occur are thermodynamically favored. GCP therefore requires no rectifier, external wiring or conduit. This simplicity increases reliability and reduces initial cost, as well as costs associated with long term monitoring and maintenance. Also, the use of GCP to protect high-strength prestressed steel from corrosion is considered inherently safe from the standpoint of hydrogen embrittlement. Recognizing these advantages, the Federal Highway Administration issued a Broad Agency Announcement (BAA) in 1992 for the study and development of sacrificial anode technology applied to reinforced and prestressed bridge components. As a result of this announcement and the technology that was developed because of this BAA, interest in GCP has greatly increased over the past few years.

In U.S. Pat. No. 6,022,469 by Page a method of galvanic cathodic protection is disclosed wherein a zinc or zinc alloy anode is surrounded by a mortar containing an agent to maintain a high pH in the mortar surrounding the anode. This agent, preferably lithium hydroxide (LiOH), serves to prevent passivation of the zinc anode and maintain the anode in an electrochemically active state. In this method, the zinc anode is electrically attached to the reinforcing steel causing protective current to flow and mitigating subsequent corrosion of the steel.

In U.S. Pat. No. 5,292,411 Bartholomew et al discloses a method of patching an eroded area of concrete comprising the use of a metal anode having an ionically conductive hydrogel attached to at least a portion of the anode. In this patent it is taught that the anode and the hydrogel are flexible and are conformed within the eroded area, the anode being in elongated foil form.

In U.S. Pat. No. 6,471,851 issued to Bennett on Oct. 29, 2002 the use of deliquescent or hygroscopic chemicals, collectively called "humectants" is disclosed to maintain a galvanic sprayed zinc anode in an active state and delivering protective current. In U.S. Pat. No. 6,033,553, two of the most effective such chemicals, namely lithium nitrate and lithium bromide ($LiNO_3$ and LiBr), are disclosed to enhance the performance of sprayed zinc anodes. And in U.S. Pat. No. 6,217,742 B1, issued Apr. 17, 2001, Bennett discloses the use of $LiNO_3$ and LiBr to enhance the performance of embedded discrete anodes. And finally, in U.S. Pat. No. 6,165,346, issued Dec. 26, 2000, Whitmore broadly claims the use of deliquescent chemicals to enhance the performance of the apparatus disclosed by Page in U.S. Pat. No. 6,022,469.

In U.S. Pat. No. 7,160,433 B2 issued Jan. 9, 2007, a method of cathodic protection of reinforcing steel is disclosed comprising a sacrificial anode embedded in an ionically conductive compressible matrix designed to absorb the expansive products of corrosion of the sacrificial anode metal.

In U.S. Pat. No. 6,572,760 B2, issued Jun. 3, 2003, Whitmore discloses the use of a deliquescent material bound into a porous anode body, which acts to maintain the anode electrochemically active, while providing room for the expansive products of corrosion. The same patent discloses several mechanical means of making electrical connection to the reinforcing steel within a hole drilled into the concrete covering material. Many of these means involve driven pins, impact tools, and other specialized techniques. These techniques are all relatively complex and difficult to perform.

Finally, in U.S. Pat. No. 6,193,857, issued Feb. 27, 2001, Davison, et al describes an anode assembly comprising a block of anode material cast around an elongated electrical connector (wire). Other claims disclose making contact between the elongated connector and the reinforcing steel by winding the connector around the reinforcing steel and twisting the ends of the connector together using a twisting tool.

The anodes described above and the means of connection disclosed have become the basis for commercial products designed to extend the life of patch repair and to cathodically protect reinforced concrete structures from corrosion. But some embodiments, such as the use of high pH to maintain the anode in an electrochemically active state as described by Page, result in protective current that is small and often inadequate to mitigate corrosion. Use of the chemicals such as lithium nitrate and lithium bromide, result in a higher current, but even this current is sometimes inadequate in cases of high chloride contamination and the presence of strong corrosion of the reinforcing steel.

Also, some of the chemicals used to maintain the zinc anode in an electrochemically active state render the corrosion products of zinc largely insoluble. In this case the expansive corrosion products apply stress to the surrounding concrete, and when this stress exceeds the tensile strength of the concrete, cracking of the concrete can occur. Although several potential solutions have been proposed, including the ionically compressible conductive matrix described in U.S. Pat. No. 7,160,433 B2, cracking remains a problem in some cases.

It would be of great benefit to increase the protective current higher than was previously possible using the prior art as described in the patent literature above. It would also be of benefit to overcome the problem of potential cracking of the overlaying concrete due to expansive corrosion products.

DISCLOSURE OF THE INVENTION

The present invention relates to an apparatus and a composite anode for cathodic protection of reinforced concrete, and more particularly, to a method and apparatus for improving the performance and service life of embedded anodes prepared from sacrificial metals such as zinc, aluminum, and alloys thereof. The present invention more specifically relates to an apparatus and a composite anode for cathodic protection wherein the performance of the sacrificial anode is enhanced by the use of a combination of chemicals and a compressible, water retaining phyllosilicate such as vermiculite in an ionically conductive material such as a cementitious grout, thereby forming an activating matrix surrounding the sacrificial anode. By 'surrounding' is meant at least partial encapsulation of the anode. This combination is particularly effective absorbing the expansive corrosion products of the zinc anode.

The chemical component of the activating matrix may be any one, or a combination of, the chemicals previously disclosed in the prior art. These include chemicals that are deliquescent or hygroscopic, also sometimes known as humectants. Such chemicals maintain the region near the anode moist and highly conductive. Particularly advantageous are lithium nitrate, lithium bromide, or other deliquescent or hygroscopic chemicals. Other chemicals intended to raise the pH of the matrix to a value greater than about 13.5 are also known to be effective.

A water-retaining phyllosilicate mineral resembling mica has been found to be a particularly useful component of the present invention. A specific form of this mineral is vermiculite. Vermiculite particles in the matrix appear to serve both functions of increasing the protective current delivered by the anode, and effectively absorbing the expansive products of corrosion. The anode itself may be in a variety of forms, but is preferably in an elongated foil, or ribbon form. The anode is composed of zinc, magnesium, aluminum or their alloys, or combinations of these metals. The ionically conductive material that binds the phyllosilicate particles together, and to the zinc anode, may be either of a cementitious nature, or may be a hydrogel, as taught by the aforementioned prior art.

The composite anode for cathodic protection also incorporates an elongated metallic conductor that serves to electrically connect the sacrificial anode to the reinforcing steel, or other metal to be protected, thereby providing an electrical path for the flow of protective current. The elongated metallic conductor may be attached to the reinforcing steel by one of several methods, such as wrapping, twisting, resistance welding, tig welding, mechanical compression and the like.

The present invention also relates to a method of cathodic protection of reinforced concrete, and more particularly, to a method of improving the performance and service life of embedded anodes intended to apply cathodic protection to reinforcing steel and other metals embedded in concrete.

BRIEF DESCRIPTION OF THE DRAWINGS

Further features of the present invention will become apparent to those skilled in the art to which the present invention relates from reading the following specification with references to the accompanying drawings, in which.

The drawings are not necessarily to scale but are merely schematic representations, not intended to portray specific parameters of the invention. The drawings are intended to depict only typical embodiments of the invention and, therefore, should not be considered as limiting the scope of the invention

MODES FOR CARRYING OUT THE INVENTION

Figure 1:
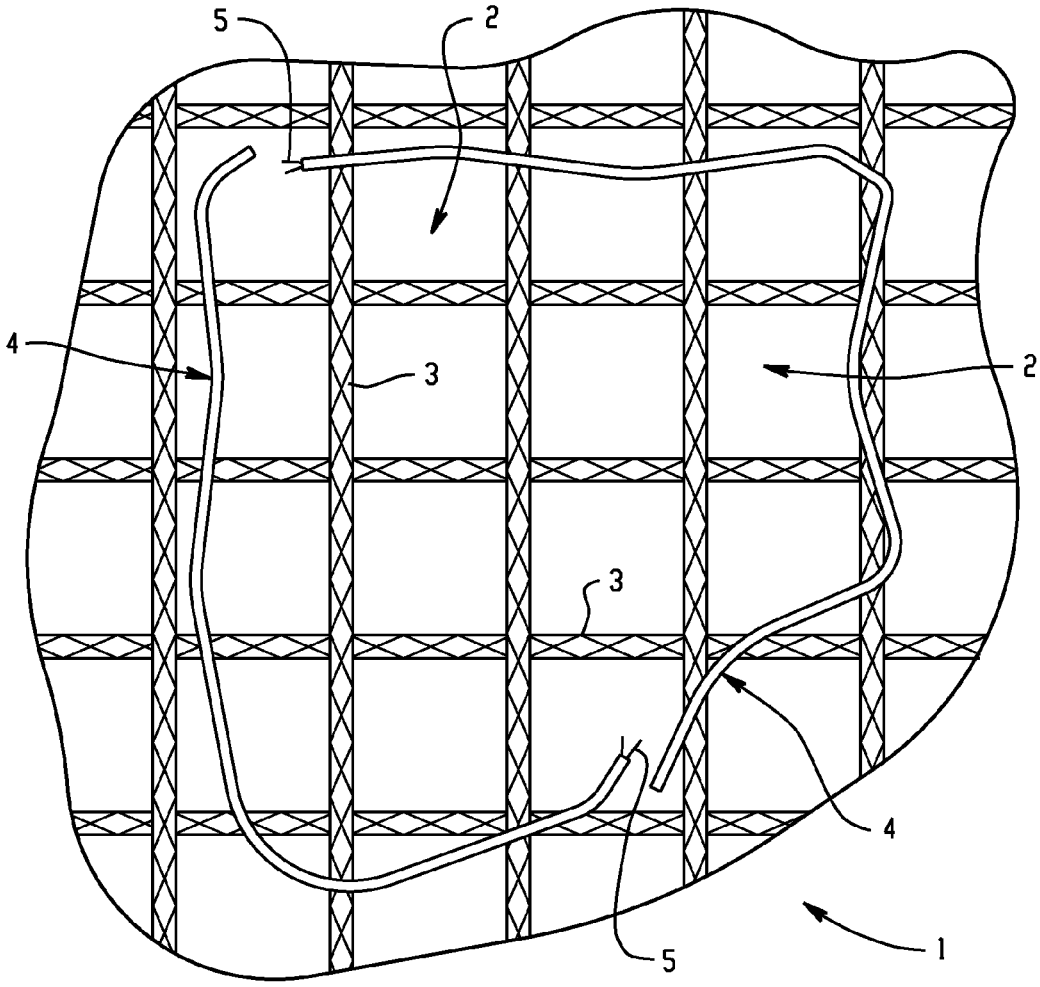
FIG. 1 illustrates one method of utilizing the anode assembly of the present invention.

Turning now to the drawings, FIG. 1 shows the surface of a reinforced concrete structure 1 in plan view with an excavation 2, where loose and delaminated concrete has been removed. Reinforcing bars 3, running both horizontally and vertically, are shown exposed in the excavation 2. A flexible, elongated anode assembly 4 is shown placed near the edge of the excavation 2. The anode assembly 4 is fastened to reinforcing bars 3 with metallic wire conductors 5 for the purpose of making contact and allowing protective current to flow. This anode assembly has a thickness of between about 0.01 inch and about 0.2 inch and a width between about 0.2 inch and about 2 inches. However, it is understood that the dimensions of the anode assembly are dictated by such parameters as the size of the excavation, and the flexibility, bend ability, and conductivity of the anode assembly, and ease of installation.

Figure 2:
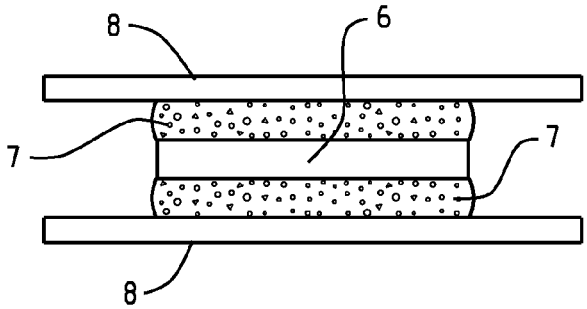
FIG. 2 illustrates the anode assembly of FIG. 1 in cross section.

FIG. 2 illustrates a cross sectional view of the structure of FIG. 1. In this Figure, the anode 6 is shown in a central configuration. The metal anode 6 is enclosed on both sides by an activating matrix 7 to form the anode assembly 4. Although not shown, the activating matrix 7 comprises an ionically conductive material, a phyllosilicate such as vermiculite, and at least one activating chemical designed to keep the anode metal in an electrochemically active state. The activating matrix 7 on each side of the anode is bound on one side by a protective plastic sheet 8, such as polyethylene, designed to protect the activating matrix 7 during shipping and handling. The protective plastic sheet 8 is removed prior to placing the patch material into the excavation.

The present invention relates broadly to all reinforced concrete structures with which cathodic protection systems are useful. Generally, the reinforcing metal in a reinforced concrete structure is carbon steel. However, other ferrous-based metals can also be used.

The anode assembly of the present invention relates to galvanic cathodic protection (GCP), that is, cathodic protection utilizing anodes consisting of sacrificial metals such as zinc, aluminum, magnesium, or alloys thereof. Of these materials, zinc or zinc alloys are preferred for reasons of efficiency, longevity, driving potential and cost. Sacrificial metals are capable of providing protective current without the use of ancillary power supplies, since the reactions that take place during their use are thermodynamically favored. The sacrificial metal anodes may be of various geometric configurations, such as flat plate, expanded or perforated sheet, or cast shapes of various designs. A preferred configuration of the anode, and anode assembly of the present invention is a flexible elongated foil, or ribbon configuration. In one embodiment of the present invention, the composite anode is elongated and flexible, in which case it is easily conformed to be placed around the edge of the excavated patch, thereby mitigating the anode ring effect of corrosion. It may also be useful to fix the elongated composite anode around the edge of the excavated patch with non-conductive ties. The ties may incorporate a non-conductive shield to prevent an excessive amount of current to pass to the reinforcing bar adjacent to the composite anode.

The anode metal is surrounded, on at least one side, by an ionically conductive material. The ionically conductive material may be one of several known conductive cementitious grouts, or may be a material known as a hydrogel. The word "hydrogel" as used herein is meant to include any ionically conductive adhesive gel which is a coagulated colloid that typically is a viscous and tacky, jellylike product. In broad terms, water can be present in the hydrogel from about 5% to 95% by weight, and is usually present in major amount, e.g. 70-90 weight percent. Preferred hydrogels for the present invention are organic, polymeric structures that have a molecular weight sufficiently high for the hydrogels to be self-supporting. It is to be understood, however, that inorganic, polymeric structured hydrogels may also be used, e.g. those based on polysilicates or polyphosphates. Moreover, the use of mixtures of organic and inorganic hydrogels is also contemplated. The self-supporting hydrogels are form stable under normal conditions, and have good ionic conductivity, as well as good adhesiveness or tackiness. This adhesiveness as well of the flexibility of the hydrogel allows it to securely adhere to the anode metal even when the metal is bent or twisted. Hydrogels useful for this invention are further specified in U.S. Pat. No. 5,292,411, the teachings of which are incorporated herein by reference.

The vermiculite used in the present invention is a phyllosilicate mineral resembling mica. Vermiculite mined in the US is a hydrated phlogopite or biotite mica that expands or delaminates to many times its volume when heated, a process called exfoliation. Vermiculite used in the present invention is in exfoliated form, and is incorporated essentially within the ionically conductive material. The particle size for the vermiculite used may range from about 0.01 to 0.1 centimeter. Vermiculite may be used in the present invention by incorporating into the activating matrix in the amount of between about 2% and about 15% of total weight, more particularly, between about 5% and about 12%.

Since sacrificial metal anodes tend to passivate in the alkaline environment of concrete, it is necessary to provide an activating agent within the ionically conductive material to maintain the anode in an electrochemically active and conductive state. As previously mentioned, the use of deliquescent or hygroscopic chemicals, collectively called "humectants" serves to maintain a galvanic sprayed zinc anode in an active state, thereby continuing to deliver protective current. Two of the most effective chemicals for this purpose, namely lithium nitrate and lithium bromide ($LiNO_3$ and LiBr), enhance the performance of sprayed zinc anodes. These two chemicals $LiNO_3$ and LiBr serve to improve the performance of embedded discrete anodes. It has been found that a mixture of lithium nitrate and lithium bromide in an amount of between about 1% and about 15% is particularly effective for this purpose.

EXAMPLE 1

A steel reinforced 12×12×4-inch (30.5×30.5×10.2 cm) concrete test block was constructed using concrete with the following mix proportions:

| | |
|---|---|
| Type 1A Portland cement - | 715 lb/yd$^3$ |
| Lake sand fine aggregate - | 1010 lb/yd$^3$ |
| No. 8 Marblehead limestone - | 1830 lb/yd$^3$ |
| Water - | 285 lb/yd$^3$ |
| Chloride (added as NaCl) - | 5 lb/yd$^3$ |
| Airmix air entrainer (0.95% oz/CWT) - | about 6.5% air |

The test block contained about 24 inches (60 cm) of #4 (12 mm dia.) reinforcing bar, or about 0.25 square feet (240 square centimeters) of steel surface area. Each test block was cast with two blockouts for two test cells, each blockout forming a circular test cavity about 4 inches (10 cm) in diameter×2.75 inches (7 cm) deep. For purposes of this invention, a 'blockout' is a block or form that is placed in wet concrete when formed. When the blockout is removed from the concrete at a later time, it leaves a cavity or void.

An anode was first constructed by soldering 40 grams of pure zinc to galvanized tie wires. The zinc was then cast into a mixture containing 65% sand, 15.2% Type III cement, and 19.8% lithium liquid mixture, prepared by combining 40% by volume saturated lithium bromide solution and 60% by volume saturated lithium nitrate solution. The mixture surrounding the anode was allowed to cure, and the anode was then placed into a cavity in the test block and mortared in place with Eucopatch, a one-part cementitious repair material produced by The Euclid Chemical Company. The anode was connected to the reinforcing bars in the test block with a 10 ohm resistor, which facilitated measurement of the flow of protective current.

This anode was subjected to 5 mA of impressed current in constant current mode of operation. In this way, a total charge equivalent to several years of service life can be impressed on the anode in a period of about 60 days. The effectiveness of the anode can be determined by observation of the cell operating voltage. Lower operating voltage indicates that an anode will deliver a higher level of protective current when operated in galvanic mode.

Figure 3:
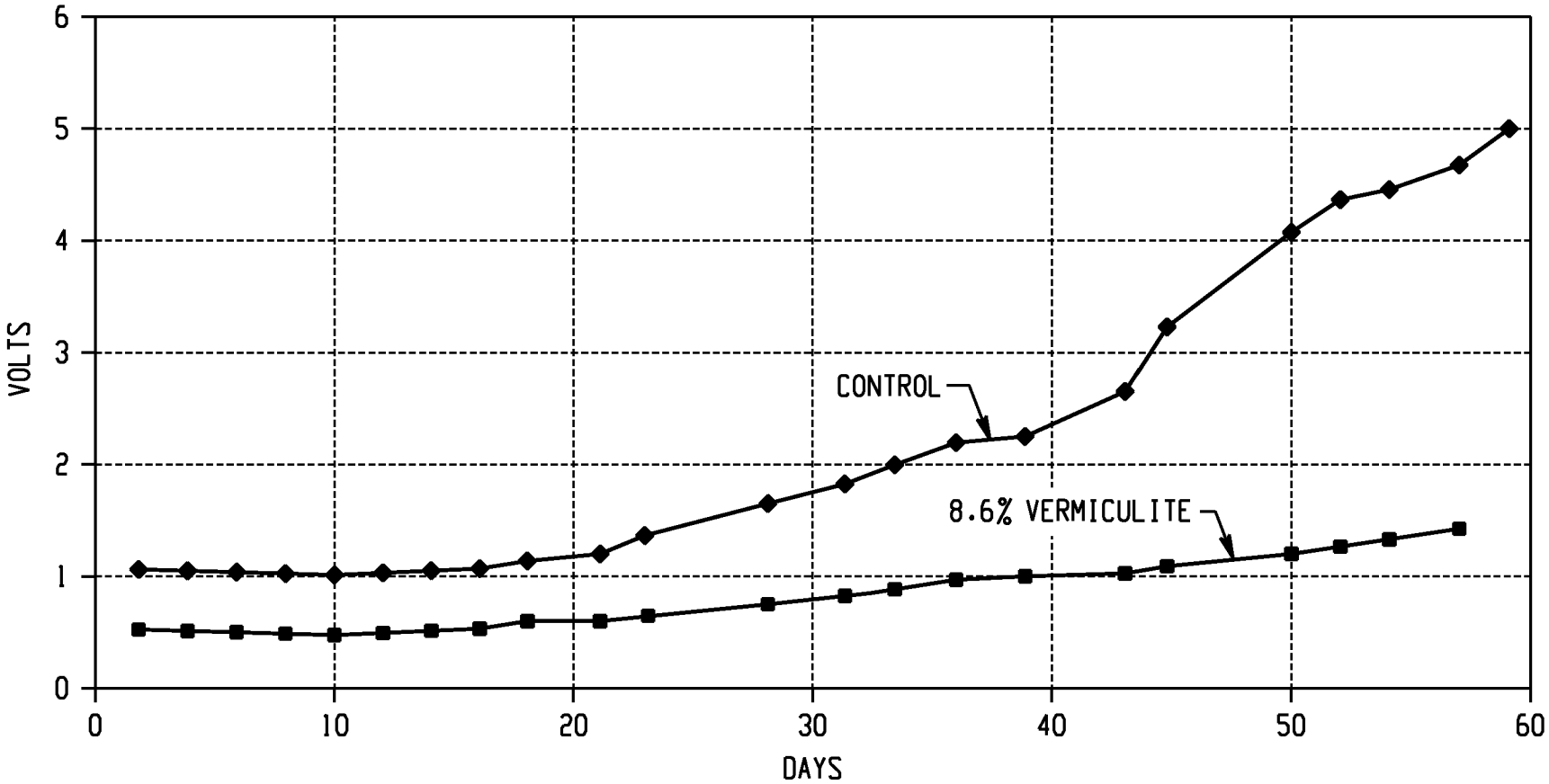
FIG. 3 illustrates the results of the tests described in Example 1 to follow.

The operating voltage of the control anode is shown by the line labeled "Control" on FIG. 3. Operating voltage began at about 1.0 volt, and increased to about 5.0 volts after 60 days.

A second anode was prepared in a similar manner, except that the matrix surrounding the anode contained 8.6% vermiculite by weight. After curing of the mortar surrounding the anode, the anode was placed into a test cavity and mortared in place with Eucopatch. This anode was connected to the reinforcing bars in the same manner as the Control. The operating voltage of the anode surrounded with the vermiculite mixture is shown by the line labeled "8.6% Vermiculite" on FIG. 3. In this case, operating voltage began at about 0.5 volts, and increased to only about 1.5 volts after 60 days. This improvement is again expected to result in a higher polarization of the steel surrounding the anode, a greater level of cathodic protection, and a longer effective service life of the anode.

FIG. 3 illustrates the results of the tests described hereinabove. This figure shows cell voltage of test blocks operated in accelerated mode using an impressed current of 5 milliamps as a function of time. The data labeled "Control" was obtained by a standard control test block as described in Example 1, and is again considered good performance. The data labeled "8.6% Vermiculite" was obtained from a test block in which 8.6% by weight of the matrix surrounding the anode consisted of vermiculite, a phyllosilicate mineral resembling mica. Following completion of the test, cracks had developed on the surface of the control block, with cracks measuring up to 0.047-inch wide after 51 days on line. Cracks were barely discernible on the surface of the block containing vermiculite, and measured no more than 0.002-inch wide after 57 days on line.

Industrial Applicability

The present invention is useful for providing an enhanced level of corrosion protection for steel reinforcement that is used in concrete structures such as bridges, buildings, parking structures, piers, and wharves.

The foregoing description of various aspects of the invention has been presented for purposes of illustration and description. It is not intended to be exhaustive or to limit the invention to the precise form disclosed and, obviously, many modifications and variations are possible. Such modifications and variations that may be apparent to a person skilled in the art are intended to be included within the scope of the invention as defined by the accompanying claims.

What I claim is:

1. A method for the cathodic protection of a reinforced concrete structure, comprising:

providing at least one sacrificial anode member;

at least partly covering said at least one sacrificial anode member with an ionically-conductive material;

incorporating at least one electrochemical activating agent within the ionically-conductive material;

incorporating a compressible water-retaining phyllosilicate mineral in exfoliated form within the ionically conductive material to absorb insoluble expansive corrosion products;

bonding at least one elongated metallic conductor to the at least one sacrificial anode member, and connecting the elongated metallic conductor to the reinforcing steel of the reinforced concrete structure, thus causing protective current to flow.

2. The method of claim 1 wherein the sacrificial anode member is zinc or a zinc alloy.

3. The method of claim 1 wherein the ionically-conductive material is selected from among the group consisting of a cementitious-based material and a hydrogel.

4. The method of claim 1 wherein the electrochemical activating agent is an alkaline hydroxide present in sufficient amount to raise the pH of the covering material above about pH 13.3.

5. The method of claim 1 wherein the electrochemical activating agent is a deliquescent or hygroscopic material selected from the group consisting of lithium nitrate, lithium bromide, and combinations thereof.

6. The method according to claim 1 wherein the compressible water-retaining mineral is incorporated into the composite in an amount of between about 2% and about 15% by weight.

7. The method according to claim 6 wherein the water-retaining mineral comprises exfoliated vermiculite.

8. A composite anode for cathodic protection of a reinforced concrete structure, comprising:

at least one sacrificial anode member;

an ionically-conductive material at least partly covering said at least one sacrificial anode member;

at least one electrochemical activating agent incorporated within the ionically-conductive material;

at least one elongated metallic conductor bonded to the at least one sacrificial anode member; and a compressible water-retaining phyllosilicate mineral in exfoliated form incorporated within the ionically conductive material to absorb insoluble expansive corrosion products.

9. The composite anode of claim 8 wherein said at least one sacrificial anode member is zinc or a zinc alloy.

10. The composite anode of claim 8 wherein the ionically-conductive material is selected from among the group consisting of a cementitious-based material and a hydrogel.

11. The composite anode of claim 8 wherein the electrochemical activating agent is an alkaline hydroxide present in sufficient amount to maintain the pH of the ionically-conductive material above about pH 13.3.

12. The composite anode of claim 8 wherein the electrochemical activating agent is a deliquescent or hygroscopic material selected from the group consisting of lithium nitrate, lithium bromide, and combinations thereof.

13. The composite according to claim 8 wherein the compressible water-retaining mineral is incorporated into the composite in an amount of between about 2% and about 15% by weight.

14. The composite according to claim 13 wherein the phyllosilicate mineral is exfoliated vermiculite.

15. A reinforced concrete structure cathodically protected by a composite anode comprising:

at least one sacrificial anode member comprising an ionically-conductive material at least partly covering said at least one composite anode;

at least one electrochemical activating agent incorporated within the ionically-conductive material;

a phyllosilicate mineral in exfoliated form incorporated within the ionically conductive material to absorb insoluble expansive corrosion products; and said at least one sacrificial anode member including at least one elongated metallic conductor bonded to the ionically conductive material.

16. The reinforced concrete structure of claim 15 wherein the composite anode member is zinc or a zinc alloy.

17. The reinforced concrete structure of claim 15 wherein the ionically-conductive covering material is a cementitious-based material or a hydrogel.

18. The reinforced concrete structure of claim 15 wherein the electrochemical activating agent is a deliquescent or hygroscopic material selected from the group consisting of lithium nitrate, lithium bromide, and combinations thereof.

19. The reinforced concrete structure according to claim 15 wherein the phyllosilicate mineral is exfoliated vermiculite which is present in the ionically conductive material in particulate form in an amount of between about 2% and about 15% by weight.

* * * * *